US005242073A

United States Patent [19]

Willis et al.

[11] Patent Number: 5,242,073

[45] Date of Patent: Sep. 7, 1993

[54] RESEALABLE CONTAINER CLOSURE

[75] Inventors: W. Coy Willis, Apollo; Scott C. Biondich, Delmont, both of Pa.

[73] Assignee: Aluminum Company of America, Pittsburgh, Pa.

[21] Appl. No.: 640,334

[22] Filed: Jan. 11, 1991

Related U.S. Application Data

[63] Continuation of Ser. No. 397,218, Aug. 23, 1989, abandoned.

[51] Int. Cl.[5] ..... B65D 53/00

[52] U.S. Cl. ..... 220/240; 220/306

[58] Field of Search ..... 220/240, 258, 306, 307; 215/317, 320, 321, 270, 271

[56] References Cited

U.S. PATENT DOCUMENTS 4,580,692 4/1986 La Barge et al. ..... 220/240

FOREIGN PATENT DOCUMENTS 106325 3/1965 Norway ..... 215/321

*Primary Examiner*—Allan N. Shoap
*Assistant Examiner*—Nova Stucker
*Attorney, Agent, or Firm*—William J. O'Rourke, Jr.

[57] ABSTRACT

This invention provides a closure cap and cap assembly for substantially gas-tight sealing engagement with a container closure having an opening therein circumscribed by a substantially smooth sealing surface thereon. The closure cap includes a sealing portion releasably engageable in surrounding gas-tight sealing relation with the sealing surface on the container closure. The sealing portion comprises elastic portions circumferentially spaced by a plurality of radially extending less elastic portions. The cap assembly of this invention may be anchored to the end wall of a container closure.

11 Claims, 3 Drawing Sheets

RESEALABLE CONTAINER CLOSURE

This is a continuation of Ser. No. 397,218, filed Aug. 23, 1989, now abandoned.

BACKGROUND OF THE INVENTION

The present invention relates to a resealable, easy open can end. More particularly, the present invention relates to a resealable closure cap and a cap assembly easily applied to a spout of a can end which is capable of accommodating inherent internal can pressures.

The prior art teaches various structures for containers such as drawn and ironed cans having end panels double seamed to the can. The end panels typically include opening devices which are generally called "easy open ends". Examples of easy open ends of the prior art are described in U.S. Pat. Nos. 3,929,251; 3,977,341; 3,997,076; 4,024,981; and 4,148,410.

The market for containers having easy open ends may be extended, particularly, though not exclusively, in the area of larger volume containers. This may be accomplished through the utilization of a cap to close and reseal the spout or pouring opening defined by the easy open end. Without a resealable closure cap, the liquid contents of an open container could easily spill or be otherwise lost. Also, dissociable gases, i.e., carbonation, in the remaining liquid are readily lost from unsealed, open containers.

One construction for a resealable closure cap assembly is taught in the prior art, namely U.S. Pat. No. 4,580,692. This reference teaches a construction for such a resealable closure cap assembly in association with a selectively contoured can end to accommodate the resealable closure and to retain the advantages characteristic of the easy open end.

The provision of commercially acceptable resealable easy open can end constructions for current and larger volume beverage containers requires ease of application of the resealing cap over the spout, sealable retention of remaining container contents and accommodation of inherent internal can pressure that builds after resealing the can. Also desired is a can end configuration having an easy open end which does not require the use of lever mechanisms or the like to accomplish opening of the pouring spout. Ideally, the easy open end is easily and readily opened by a user through the mere application of digital pressure in a simple and safe manner. Such construction of a resealable easy open can end should be accomplished without diminution of the convenience and cost effective nature of the basic easy open end construction during manufacturing, filling, handling, shipping, distributing, selling and consumer usage.

Experience to date with resealable caps and can end constructions, such as those disclosed in U.S. Pat. Nos. 4,580,692 and 4,648,528, the contents of which are incorporated herein by reference, has indicated a need to assure proper application and retention of the resealable cap over the spout defined by the easy open end. Despite attempts and progress in this area of resealable container closures, there is still a need and a demand for further improvement.

Accordingly, a new and improved resealable container closure is desired which is easily applied to the spout to provide an effective seal for an opened container.

SUMMARY OF THE INVENTION

This invention may be summarized as providing a closure cap for substantially gas-tight sealing engagement with a container closure having an opening therein circumscribed by a substantially smooth sealing surface thereon. The closure cap includes a sealing portion releasably engageable in surrounding gas-tight sealing relation with the sealing surface on the container closure. The sealing portion comprises elastic portions circumferentially spaced by a plurality of radially extending less elastic portions. The cap assembly of this invention may be anchored to the end wall of a sheet metal container closure.

Among the advantages of this invention is the provision of a resealable container closure for a can which is easily and effectively applied over an open spout on a can end.

Another advantage of the present invention is the provision of a resealable container closure for a can which, when applied over an open spout, creates and maintains an effective seal to hold the contents and the internal can pressure.

An objective of this invention is to provide an improved construction for a resealable container closure for easy open end beverage containers and the like.

A feature of this invention is the ability to provide an effective closing and sealing mechanism for a can end which allows the use of larger volume containers because such containers may be effectively sealed to retain carbonation over longer storage periods required to consume such larger volumes of container contents.

These and other advantages and objectives of the invention will be more thoroughly understood and appreciated with reference to the following description and the accompanying drawings which illustrate, in accordance with the mandate of the patent statutes, a presently preferred embodiment of a container closure construction incorporating the principles of this invention.

DETAILED DESCRIPTION OF THE INVENTION

As noted above, the present invention is described in association with a resealable easy open end construction of the type generally disclosed in U.S. Pat. Nos. 4,580,692 and 4,648,528 which are incorporated by reference. However, it should be understood that the present invention may be used in other easy open can end constructions.

Where the words "upwardly", "inward", "outwardly", "under", "underside", "downwardly" and the like are used in this application, the meaning, unless specifically indicated to the contrary, is to be applied with reference to a can standing on its base in an upright position having a can end incorporating this invention attached to the top end thereof.

Figure 1:
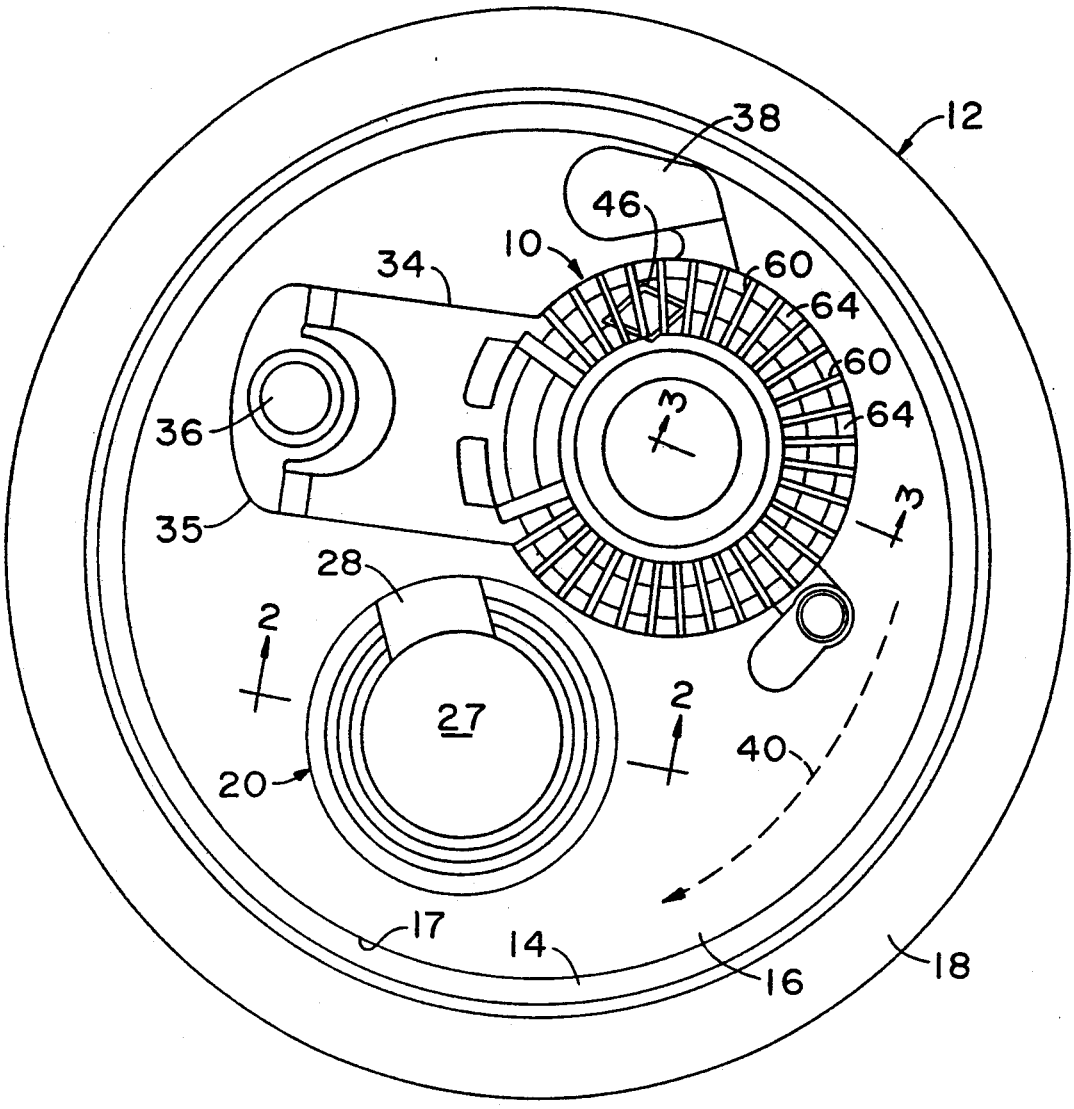
FIG. 1 is a top plan view of an easy open can end construction incorporating the principles of this invention.

Referring particularly to the drawings, FIG. 1 illustrates a top plan view of an easy open can end construction incorporating the principles of this invention. FIG. 1 shows a can end closure 12 prior to engagement of the can end closure at the top end of a generally cylindrical can body, such as by conventional double seaming. Such can end closure 12 is generally made of sheet metal, such as aluminum, steel or tinplate, but may be made of nonmetallic or laminate material. The closure 12 includes a generally flat or planar end wall 16, a countersink defining an inner panel wall 17, and an outer chuckwall 14 terminating in an upwardly and outwardly projecting annular flange 18 forming a chime for conventional attachment of the sheet metal can end 12 to a can body by double seaming.

Figure 2:
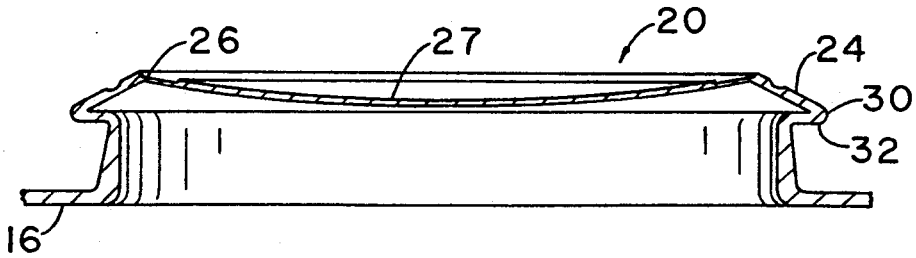
FIG. 2 is a horizontal section as taken along the line 2—2 in FIG. 1.
Figure 3:
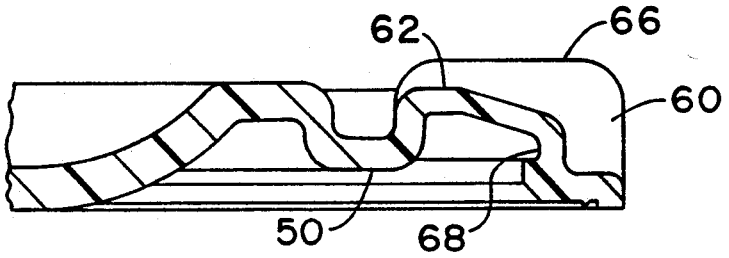
FIG. 3 is an enlarged horizontal section as taken along the line 3—3 in FIG. 1.
Figure 4:
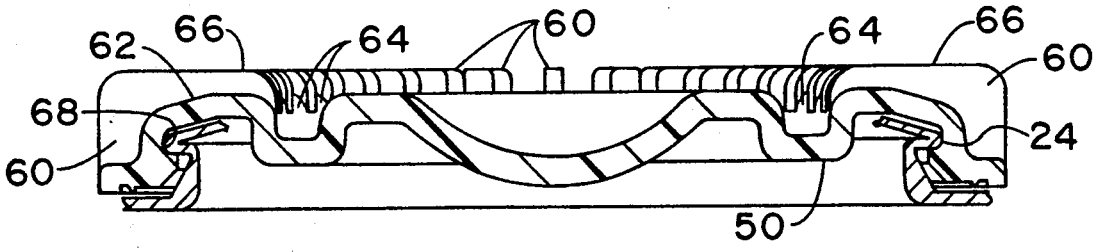
FIG. 4 is a section showing the cap member disposed in superposed sealing relation on the spout of FIG. 2.

As best shown in FIGS. 1 and 2, the can end closure 12 further includes an upwardly projecting dispensing spout 20 or pouring opening. The spout 20 is typically of circular configuration and is formed as an integral portion of the can end closure. Although the preferred spout 20 is circular, it should be understood that alternate configurations, including oval, teardrop and ellipsoidal shapes, are comprehended by the present invention. The spout 20 may include a domed surface having a score line 26. The score is interrupted by a hinge 28, but otherwise the score line 26 circumscribes and defines an opening panel 27 which is depressable inwardly of the can upon fracture of the score line 26. The opening panel 27 and the score line 26 are surrounded by a continuous lip 24 having substantially smooth sealing surfaces 30 and 32. In the preferred embodiments, the lip 24 is circular.

As illustrated in the drawing, the present invention pertains to a resealing cap 10 which, as described below, is disposable over the lip 24 to seal the container over the spout 20, or pouring opening. The cap 10 is preferably molded in one piece of a resinous or plastic material having a relatively low modulus of elasticity, such as, for example, low density polyethylene, polyvinyl, polyester, polyurethane or nylon. In addition to a low modulus of elasticity, suitable cap materials typically exhibit thermal and dimensional stability, chemical resistance, strength and durability.

The resealing cap 10 includes a sealing portion about the locking recess 68, adapted to be placed in sealing relation over the spout 20 and the score line defined opening panel 27 therein. The cap 10 also includes an integral tab 38 projecting outwardly from the cap portion for convenience in digitally manipulating the cap 10. In a preferred embodiment illustrated in the drawing, an integral extending arm 34 extends from the cap assembly 10 and terminates in a boss 35. The boss 35 has an opening therethrough to accommodate a rivet 36 for securing the cap assembly 10 to the sheet metal can end closure. An example of an alternate lid to which the cap assembly of this invention may be applied, such as by an integral rivet, is described in U.S. patent application Ser. No. 07/302,016, filed Jan. 26, 1989, and assigned to the assignee of this invention.

The outboard edge of a flange of the rivet 36 is formed downwardly a controlled amount when the rivet 36 is staked to securely attach the cap assembly 10 to the can end closure 12. The rivet 36 also permits the cap assembly 10 to be rotated by hand about the rivet 36 with relative ease as indicated by dotted line 40, also called the locus of securement. Preferably the rivet is an integrally formed portion of a sheet metal end wall 16.

It has been found that a closure cap 10 of this invention requires sufficient resiliency or flexure to be able to be stretched over the lip 24 of the spout 20 as the cap 10 is being applied. It is also desirable to maximize the sealability of a closure cap 10 after it has been applied in order to provide a structure which does not yield from its sealing engagement when subjected to internal can pressure situations. These two objectives of resiliency and sealabililty may appear to be somewhat contrary to one another, and prior to this invention it was generally believed that a successful closure cap 10 would be one having a structure which would strike a very delicate balance between the flexibility considered necessary to provide resiliency and the rigidity considered necessary to provide sealability.

The structure of the closure cap assembly 10 of the present invention provides a device which is able to maximize the need for flexibility while simultaneously maximizing the sealability necessary to withhold high internal can pressures. This surprising combination of seemingly inconsistent and countervailing properties is accomplished by radially alternating a plurality of elastic and less elastic portions about the majority of the circumference or perimeter of the cap assembly 10 as described in this patent application. Less elastic portions include those portions which require more stress to cause deformation as compared to the elastic portions, yet both the elastic and the less elastic portions have the ability to return to their original dimensions after the removal of stresses.

Figure 5:
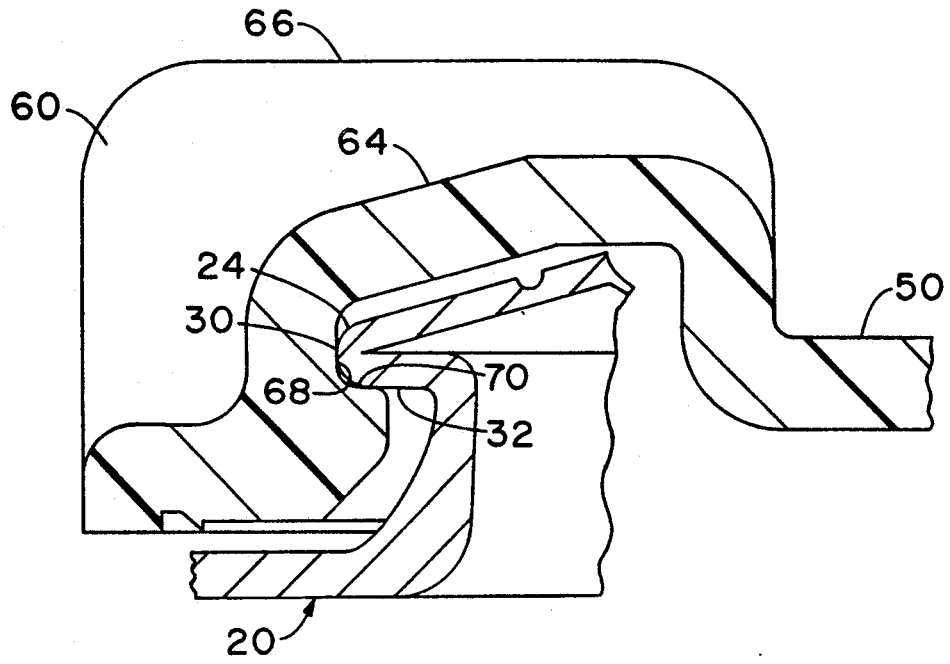
FIGS. 5 and 6 are enlarged sections showing a closure cap in superposed sealing relation on the spout of FIG. 2.

In a preferred embodiment illustrated in the drawings, the closure cap 10 is provided with a series of radially extending ribs 60. As illustrated in the drawings, the ribs 60 extend radially outwardly from a location on the cap assembly 10 which is inwardly of the lip 24 when the cap assembly 10 is disposed in overlying sealing relation with the lip 24. The ribs 60 extend outwardly to a location on the cap assembly 10 which is at or beyond the lip 24 when the cap assembly is disposed in overlying sealing relation with the lip 24. In one preferred embodiment each rib 60 begins at a location adjacent an outer portion of the boss 50 and extends radially outwardly, with a generally planar, thin top surface 66, to a radial location coterminous with the outside diameter of the body of the cap assembly 10, as shown in FIG. 5.

The ribs 60 may be provided at successive locations, such as every 8 to 10 degrees around at least a majority of the circumference of the preferred round cap assembly 10. In one embodiment, the ribs 60 may be successively provided around the entire circumference of such cap assembly 10. In FIG. 1 the closure 10 is provided with ribs 60 around about 310° of the circumference of the cap assembly 10. In a preferred embodiment the ribs 60 have a circumferential width within the range of from about 0.020 to about 0.030 inch. Each rib 60 has a height which extends above the general plane of the upper surface 62 of the cap assembly 10 as defined by the membrane portions 64 between the alternating ribs 60. In a preferred embodiment, the upper surface of the ribs 60 provide locations having a greater height than the height of the balance of the membrane portions 64 of the cap assembly 10 between the ribs 60. Such rib height, or increased cap assembly thickness, provide a plurality of portions or zones about the circumference of the cap assembly 10 which exhibit less elasticity than the thinner cap assembly membrane portions 64, or zones, between the ribs 60. It will be appreciated by those skilled in the art that the height of the ribs 60 may have to be limited to that height which will not interfere with stable vertical stacking of the containers.

Although the rib structure is preferred, the present invention contemplates the use of radially alternating materials with dissimilar elastic properties about the circumference of the cap assembly 10. Likewise, the present invention contemplates the use of radially alternating dissimilar materials about the circumference of the closure cap assembly 10. However, the use of a cap assembly with radially alternating zones of varying thickness, or height, is considered the best mode of the present invention.

The elastic portions 64, or membranes between the radial ribs 60, preferably have a wall thickness, or height, of less than about 0.030 inch, and more preferably from about 0.015 to 0.025 inch. In one preferred embodiment the wall thickness of the elastic membrane 64 tapers from a thickness of about 0.025 inch at a location inwardly of the lip 24 to a thickness of about 0.015 inch at a location at or outwardly of the lip 24. Such elastic membranes 64 provide adequate flexibility, particularly though not exclusively in the arcuate directions, to permit the cap assembly 10 to flex as the cap assembly 10 is digitally applied over the lip 24 of the pour spout 20 as explained in detail below.

In operation of the cap assembly 10 of the present invention, the user typically receives a beer or beverage container with a cap assembly 10 disposed remote from the pour spout 20. The cap assembly 10, though secured and hinged by a rivet 36, may be provided with an additional temporary securing mechanism or device, not shown, to prevent undesired rotational movement of the cap assembly 10 during handling prior to consumer use.

In a preferred embodiment, the sealing cap assembly 10 is adapted to be pivotally displaced about the rivet 36 from a first location remote from the opening panel 27 and pouring spout 20 to a second location in overlying, sealing relation with the opening panel 27 and pouring spout 20. When the user intends to open the container, the cap assembly 10 may be rotated or otherwise positioned such that it is disposed directly over the opening panel 27 prior to the digital initiation of fracture of the score line 26 defining the spout 20. A clearly visible pressure point location indicia, such as pressure index 46, may be provided on the cap assembly at a predetermined location on the upper surface of the cap assembly 10. Such pressure index 46, which may be of rhomboid character and molded on the cap surface, may cover an included circumferential extent of about 70° and serve to provide maximum visibility within the limited space available. Such pressure point location indicia 46 is located in radial alignment with and above a selectively shaped and located, downwardly projecting boss 50 on the undersurface of the closure cap 10.

The boss 50 is suitably in the nature of a downwardly projecting extension. As will be apparent, the boss 50 serves to enhance and magnify unit pressures at the point of digital contact to initiate fracture of the score line 20 when it is desired to gain access to an unopened container. Once initiated, the balance of the fracture of the score line 20 from one end of the hinge 28 to the other end of the hinge 28 may be attained with relatively minor digital pressure. The reseal cap assembly 10 is typically pivoted away from the pour spout after the score line 20 has been fractured. As the score line 20 is fractured, the panel 27 bends inwardly, about the hinge 28, to result in an unobstructed pour spout through which the liquid contents of the container may be poured.

After a portion of the contents of the container have been removed, it may be desirable to reseal the container. Such resealing is desirable, for example, to maintain carbonation in a beverage as well as to prevent spillage of the contents and to keep foreign elements from entering the opening of a container. It will be understood by those skilled in the art that carbonated beverages typically release dissociable gas, i.e., carbonation, unless and until gas equilibrium is reached and maintained. This is accomplished in a container by providing an effective gas-tight seal. The present invention provides a closure cap 10 for providing substantially gas-tight sealing engagement over the lip 24 of an open pour spout 20.

To reseal the container, the cap assembly 10 as shown in the drawing is rotationally pivoted directly over the pour spout 20. Then, downward pressure is exerted against the upper surface of the cap assembly 10, preferably at locations near the circumferential edges of the cap assembly 10. Such pressure forces a circumferential inwardly facing recess 68 in the cap assembly 10 over the circumferential outwardly facing lip 24 defining the pour spout 20. It will be appreciated that during the application of such pressure, the elastic zones or membranes 64 in the closure cap 10 yield as required to permit the cap temporarily to expand or deform slightly, as required, to fit over the lip 24 around the circumference or perimeter of the pour spout 20. It will be appreciated by those skilled in the art that the cap material will deform or flex over the lip 24, well within the elastic limit of the cap material. After the elastic membrane 64 has stretched slightly, as downward pressure continues the locking recess 68 in the cap assembly 10 seats against the outwardly projecting lip 24 as the flexed cap returns through its resilience to its unflexed shape. The user will have a positive indication, through sight and through feel, that the cap assembly 10 is disposed in surrounding gas-tight sealing relation with the sealing surface 32 on the lip 24 of the pour spout 20 about the entire circumference of the lip 24.

The effectiveness of the gas-tight seal between the closure cap 10 and the pour spout 20 is dependent on a number of variables. First, the interference fit between the lip 24 and the locking recess 68 is such that the lip 24 has an outside diameter equal to or greater than the inside diameter of the locking recess 68. Preferably, the outside diameter of the lip 24 is from 0.005 to 0.010 inch greater than the inside diameter of the locking recess 68 to provide a tight fit therebetween. The tight fit in such embodiment is obtained as the cap 10 attempts to return to its original dimensions, yet is prevented from accomplishing full return by the interference fit with the lip 24 and thereby retains a slight degree of stress in the cap 10. Secondly, the sealing surface 70 of the locking recess 68 intimately contacts at least a portion of the sealing surface 32 of the lip 24, such as for a radial contact width of at least 0.004 inch and preferably at least 0.005 inch under the lip 24 and about the circumference of the pour spout 20. Also, the contacting surfaces, i.e., the sealing surface 30 of the lip 24 and the sealing surface 70 of the recess 68, provide a gas-tight seal at least at one point therebetween about the circumference of the pour spout 20. This gas-tight seal may be accomplished by providing substantially smooth sealing surfaces 30 and 70 which circumscribe the opening in the sheet metal container closure 12. Smooth sealing surfaces are those which enhance a gas-tight seal therebetween by inhibiting or restricting gas transfer therebetween. Alternatively, one or more sealing surfaces may be treated, such as with a blooming agent that provides a thin film or wax layer which acts to accommodate surface imperfections at the sealing interface as necessary to insure a gas-tight seal therebetween.

Figure 6:
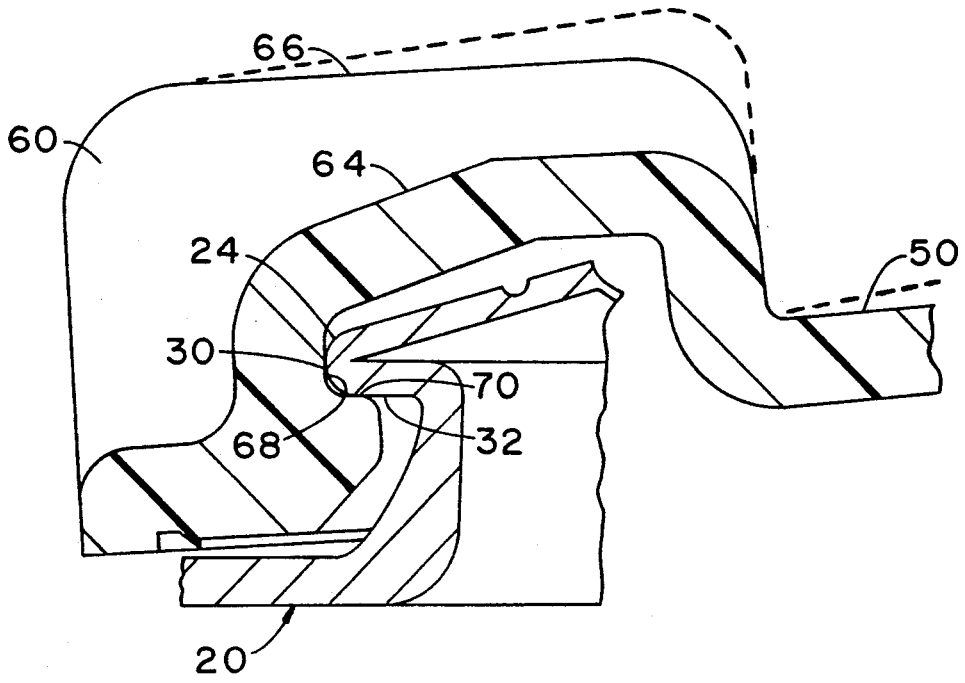

Once sealed with the closure cap 10, the container is typically, though not exclusively, stored on its base. During storage of such container, gases may become disassociated with the remaining beverage in the container to cause internal can pressures on the order of about 30 to about 60 pounds per square inch or higher to be exerted against the cap assembly 10. When such internal can pressure increases, such pressure may cause the closure cap 10 to flex somewhat, such as from the position shown in FIG. 5 to a position such as that shown in FIG. 6. It will be appreciated by those skilled in the art that closure cap 10 movement, such as that from FIG. 5 to that of FIG. 6, may be more or less dramatic than that illustrated in the drawings. In particular, the rib 60 and the loop or boss 50 may rotate upwardly more or less than that shown in phantom lines in FIG. 6 depending on such variables as internal can pressure, cap 10 material, and the like.

Internal can pressure may cause a closure cap 10, particularly at locations of the flexible membrane 64, to lift above and away from an upper portion of the pour spout 20. However, the structure of the cap assembly 10, with the alternating less elastic portions, or ribs 60, resists flexure above and away from the pour spout 20. Furthermore, the ribs 60 serve to enhance the seal between adjacent sealing surfaces 30 and 70 in response to such internal pressures. This enhanced seal is believed to result from an increase in the hoop strength of the pressure lifted cap assembly 10. And, such enhanced seal serves to anchor the cap assembly 10 firmly in its position about the lip 24 of the pour spout 20.

When it is desired to regain access to the contents of the resealed container, the user lifts the cap assembly 10. The cap assembly 10 may be lifted such as by grasping an integral tab 38 between the thumb and forefinger and lifting. It has been found that an inward rolling type motion is desirable to initiate the separation and release of the cap assembly 10 from its engagement under the lip 24 of the pour spout 20. The alternating radial elastic and less elastic structure of the cap assembly 10, providing circumferentially or perimetrically spaced elastic and less elastic portions, promotes removal of the cap assembly 10 in the same general fashion that facilitates application of the closure cap 10. Once the closure cap assembly 10 has been lifted from the lip 24, the cap 10 may be pivotally rotated about the rivet 36, in those applications in which a rivet 36 is utilized, to provide unobstructed access to the remaining contents of the can through the open pour spout 20. It will be appreciated that multiple resealing operations are comprehended with the cap assembly 10 of this invention as may be necessary or appropriate over the life of a large volume container with which the cap assembly 10 may be utilized.

What is believed to be the best mode of the invention has been described above. It will be apparent to those skilled in the art that numerous variations of the illustrated and described details may be made without departing from the scope of this invention.

We claim:

1. A closure assembly for a metallic container comprising:

an end wall having an upwardly projecting spout thereon with a score line defined opening panel therein for forming a pouring opening therein for dispensing of the contents from the container, said spout having an outwardly extending continuous lip portion having a substantially smooth sealing surface thereon, means about the periphery of the end wall for attaching the closure to the container, and a flexible cap secured to the end wall for resealing the container when disposed in overlying sealing relation with the lip portion, said cap comprising:

a sealing portion is releasably engageable in surrounding substantially gas-tight sealing relation with the sealing surface on the lip of the pour spout, said sealing portion having a plurality off radially extending elastic portions, having flexibility for circumferential expansion in applying the cap over the spout, spaced by a plurality of less elastic portions radially extending outwardly from locations radially inwardly of the underlying lip as the sealing portion is engaged with the lip, and a nonplanar surface having an annular strengthening channel disposed radially inwardly of the radially extending less elastic portions, said nonplanar surface adapted to bulge outwardly under pressure a sufficient degree to provide a visual indicator of a seal.

2. A closure assembly for a container as set forth in claim 1 wherein an extending arm, integrally connected to the cap, extends from the cap and terminates in a boss anchored to said end wall.

3. A closure for a container as set forth in claim 2 wherein the cap is pivotally secured to the end wall of the boss, and is rotatably displaceable about a locus of securement, for transposition immediate a first location remote from the pouring opening and a second location overlying and in sealing relation with the opening panel.

4. A closure for a container as set forth in claim 2 wherein the boss has an opening therethrough to accommodate a rivet for pivotal securement to the closure.

5. A closure for a container as set forth in claim 1 wherein the radially extending ribs have a thickness greater than the thickness of the elastic portions.

6. A closure for a container as set forth in claim 1 wherein the cap is a material selected from the group consisting of nylon, polyvinyl, polyester, polyurethane, and polyethylene.

7. A closure for a container as set forth in claim 1 wherein each radially extending rib has a width of from about 0.020 to 0.030 inch.

8. A closure for a container as set forth in claim 1 wherein a plurality of radially extending ribs are provided at successive locations every 8 to 10 degrees around at least a majority of the circumference of the sealing portion.

9. A closure for a container as set forth in claim 8 wherein the ribs are substantially uniformly spaced around the entire circumference of the sealing portion.

10. A closure for a container as set forth in claim 1 wherein the thickness of each elastic portion is in the range of about 0.010 to 0.030 inch where the sealing portion engages the sealing surface.

11. A closure assembly for a rigid metal container comprising:

an aluminum end wall having a score line defined opening panel defining a pouring opening therein for dispensing of the contents from the container, said opening panel having a spout therearound with an outwardly extending continuous, circular lip portion having a substantially smooth sealing surface thereon, a peripheral double seam for attaching the closure about the circumference of the container, and a flexible cap for resealing the container when disposed about the sealing surface, rotatably secured to the end wall, and pivotably movable along a locus of securement into overlying sealing relation with the lip portion, said cap comprising:

a connecting boss at which the cap is riveted to the end wall, a top wall having a plurality of nonplanar central surface portions including an annular boss and an arcuate central portion, said portions adapted to bulge outwardly under pressure, and a skirt therearound which includes a sealing portion releasably engageable in surrounding substantially gas-tight sealing relation with the sealing surface on the lip of the pour spout, said sealing portion having a plurality of ribs extending generally radially outwardly in at least the outer portion of said top wall from locations radially outwardly of the annular boss and into said skirt to provide resistance to bending thereof, said ribs circumferentially spaced approximately each 8° to 10° about the majority of the circumference of the sealing portion by radially extending flexible membranes, said membranes circumferentially expandable in applying the cap over the spout, and said membranes having a thickness less than about 0.030 inch and less than the thickness of the ribs, said ribs of a height above the general plane of the top wall so as to allow stable vertical stacking of said rigid metal containers, and an extending arm integrally connecting the connecting boss and the sealing portions.

* * * * *